US006457711B1

(12) United States Patent
Baulesh

(10) Patent No.: US 6,457,711 B1
(45) Date of Patent: Oct. 1, 2002

(54) HOCKEY GAME AND APPARATUS

(76) Inventor: Robert Baulesh, 660 Zuni Cir., Fort Collins, CO (US) 80526

( * ) Notice: Subject to any disclaimer, the term of this patent is extended or adjusted under 35 U.S.C. 154(b) by 0 days.

(21) Appl. No.: 09/881,889

(22) Filed: Jun. 15, 2001

(51) Int. Cl.[7] ..... A63B 67/04; A63F 7/06

(52) U.S. Cl. ..... 273/108.1; 273/108.5; 273/126 R

(58) Field of Search ..... 273/126 R, 108.1, 273/129 K, 129 L, 108.5, 108.21, 126 A, 127 R, 317.1; 473/162, 471

(56) References Cited

U.S. PATENT DOCUMENTS 855,728 A * 6/1907 Pingrey
1,144,112 A * 6/1915 Denny
1,593,421 A * 7/1926 Blum
2,025,183 A * 12/1935 Stayton
2,252,451 A * 8/1941 Anderson
3,482,837 A * 12/1969 Myers
3,734,504 A * 5/1973 Breslow
3,831,949 A * 8/1974 Henning
3,868,111 A * 2/1975 Schuelke
4,018,443 A 4/1977 Bird
4,166,620 A * 9/1979 Sheppard
4,429,881 A * 2/1984 Barrett
4,560,163 A * 12/1985 Erickson
4,775,152 A * 10/1988 Roehl
4,872,679 A 10/1989 Bohaski et al.
5,046,734 A 9/1991 Laine
5,242,164 A 9/1993 Nicoll
5,342,050 A 8/1994 Thompson
5,417,421 A * 5/1995 Bagley
5,672,129 A 9/1997 Fisher et al.
5,785,615 A * 7/1998 Kosmalski
D400,951 S 11/1998 Nally et al.
5,882,007 A * 3/1999 Gay
5,975,526 A * 11/1999 Hoffman

* cited by examiner

*Primary Examiner*—Sebastiano Passaniti

(57) ABSTRACT

A hockey game and apparatus for entertainment and teaching hockey stick handling skills. The hockey game and apparatus includes a collapsible perimeter frame having a pair of end boards and a pair of side boards, each of the end boards has an aperture therein defining a goal. A plurality of dividers is extendable between and removably attachable to each of the side boards. A first two of the dividers has an opening therein positioned generally between opposite ends of the divider and extending through a bottom edge of the dividers. A second two of the dividers has a pair of spaced openings therein extending through the bottom edge of the dividers. The game includes a hockey puck and a pair of hockey sticks. The players each choose a goal and attempt to move the hockey puck through the openings in the dividers and into the other player's goal.

7 Claims, 4 Drawing Sheets

HOCKEY GAME AND APPARATUS

BACKGROUND OF THE INVENTION

1. Field of the Invention

The present invention relates to hockey games and more particularly pertains to a new hockey game and apparatus for teaching stick handling skills.

2. Description of the Prior Art

The use of hockey games is known in the prior art. More specifically, hockey games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,018,443; 5,672,129; 4,872,679; 5,046,734; 5,242,164; 5,342,050; and U.S. Des. Pat. No. 400,951.

While these devices fulfill their respective, particular objectives and requirements, the aforementioned patents do not disclose a new hockey game and apparatus. The inventive device includes a collapsible perimeter frame having a pair of end boards and a pair of side boards, each of the end boards has an aperture therein defining a goal. A plurality of dividers is extendable between and removably attachable to each of the side boards. A first two of the dividers has an opening therein positioned generally between opposite ends of the divider and extending through a bottom edge of the dividers. A second two of the dividers has a pair of spaced openings therein extending through the bottom edge of the dividers. The game includes a hockey puck and a pair of hockey sticks. The hockey puck is positioned within perimeter frame. The players each choose a goal. The players attempt to move the hockey puck through the openings in the dividers and into the other player's goal.

In these respects, the hockey game and apparatus according to the present invention substantially departs from the conventional concepts and designs of the prior art, and in so doing provides an apparatus primarily developed for the purpose of teaching stick handling skills.

SUMMARY OF THE INVENTION

In view of the foregoing disadvantages inherent in the known types of hockey games now present in the prior art, the present invention provides a new hockey game and apparatus construction wherein the same can be utilized for teaching stick handling skills.

The general purpose of the present invention, which will be described subsequently in greater detail, is to provide a new hockey game and apparatus apparatus and method which has many of the advantages of the hockey games mentioned heretofore and many novel features that result in a new hockey game and apparatus which is not anticipated, rendered obvious, suggested, or even implied by any of the prior art hockey games, either alone or in any combination thereof.

To attain this, the present invention generally comprises a collapsible perimeter frame having a pair of end boards and a pair of side boards, each of the end boards has an aperture therein defining a goal. A plurality of dividers is extendable between and removably attachable to each of the side boards. A first two of the dividers has an opening therein positioned generally between opposite ends of the divider and extending through a bottom edge of the dividers. A second two of the dividers has a pair of spaced openings therein extending through the bottom edge of the dividers. The game includes a hockey puck and a pair of hockey sticks. The hockey puck is positioned within perimeter frame. The players each choose a goal. The players attempt to move the hockey puck through the openings in the dividers and into the other player's goal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hockey game and apparatus apparatus and method which has many of the advantages of the hockey games mentioned heretofore and many novel features that result in a new hockey game and apparatus which is not anticipated, rendered obvious, suggested, or even implied by any of the prior art hockey games, either alone or in any combination thereof.

It is another object of the present invention to provide a new hockey game and apparatus which may be easily and efficiently manufactured and marketed.

It is a further object of the present invention to provide a new hockey game and apparatus which is of a durable and reliable construction.

An even further object of the present invention is to provide a new hockey game and apparatus which is susceptible of a low cost of manufacture with regard to both materials and labor, and which accordingly is then susceptible of low prices of sale to the consuming public, thereby making such hockey game and apparatus economically available to the buying public.

Still yet another object of the present invention is to provide a new hockey game and apparatus which provides in the apparatuses and methods of the prior art some of the advantages thereof, while simultaneously overcoming some of the disadvantages normally associated therewith.

Still another object of the present invention is to provide a new hockey game and apparatus for teaching stick handling skills.

Yet another object of the present invention is to provide a new hockey game and apparatus which includes a collapsible perimeter frame having a pair of end boards and a pair of side boards, each of the end boards has an aperture therein defining a goal. A plurality of dividers is extendable between and removably attachable to each of the side boards. A first two of the dividers has an opening therein positioned generally between opposite ends of the divider and extending through a bottom edge of the dividers. A second two of the dividers has a pair of spaced openings therein extending through the bottom edge of the dividers. The game includes a hockey puck and a pair of hockey sticks. The hockey puck is positioned within perimeter frame. The players each choose a goal. The players attempt to move the hockey puck through the openings in the dividers and into the other player's goal.

Still yet another object of the present invention is to provide a new hockey game and apparatus that has dividers which are removable and interchangeable for changing the layout of the game.

Even still another object of the present invention is to provide a new hockey game and apparatus that has a collapsible perimeter frame for easy storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
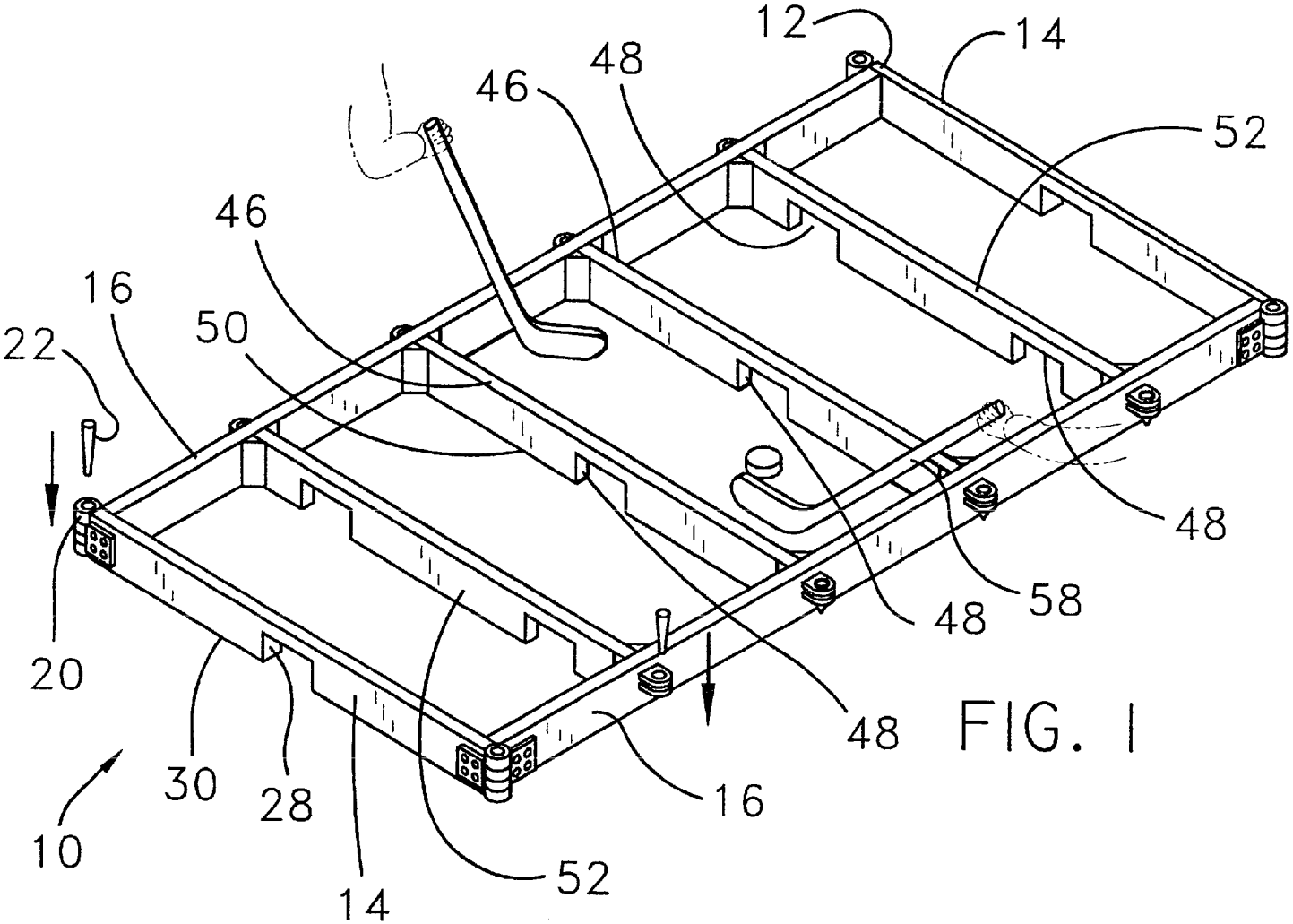
FIG. 1 is a schematic perspective view of a new hockey game and apparatus according to the present invention.
Figure 2:
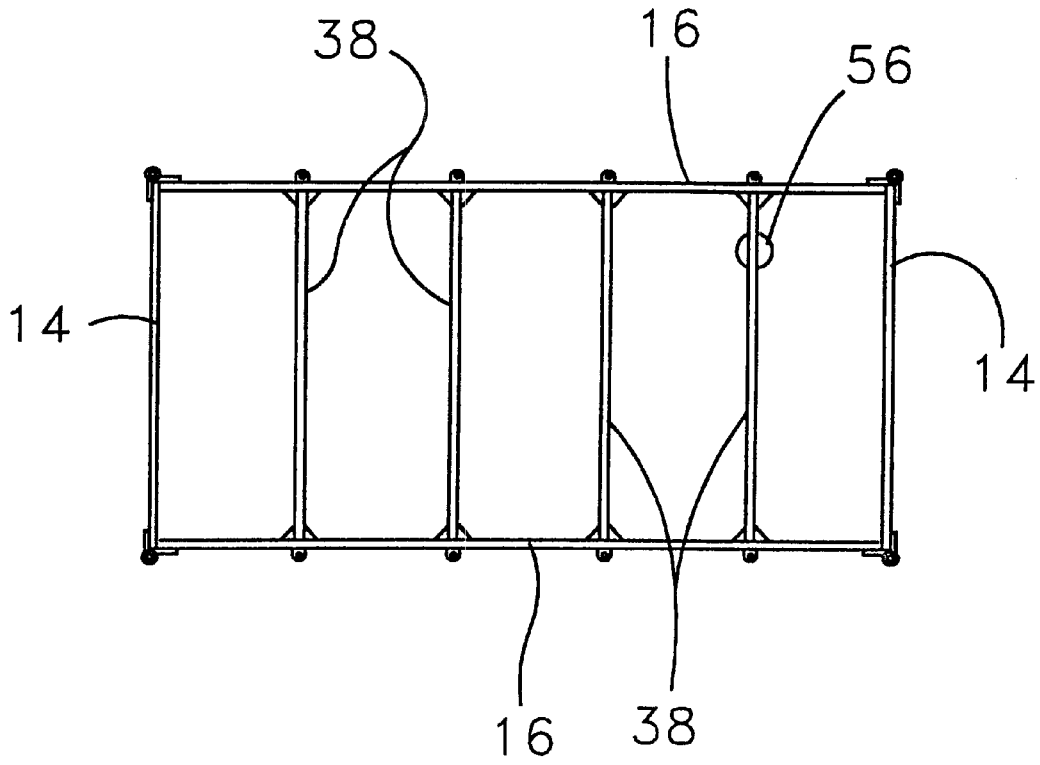
FIG. 2 is a schematic top view of the present invention.
Figure 3:
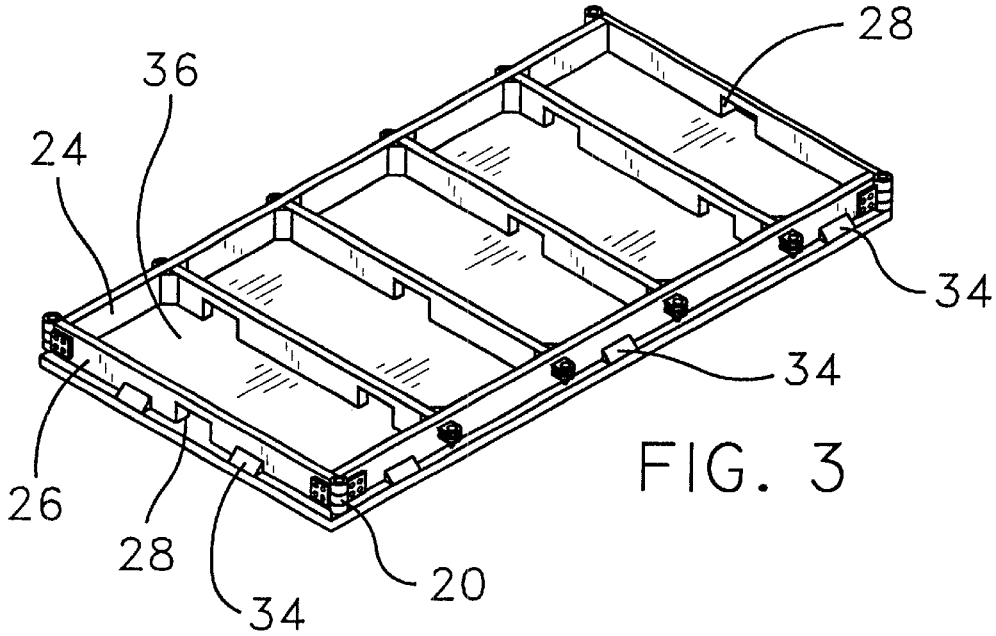
FIG. 3 is a schematic perspective view of the present invention.
Figure 4:
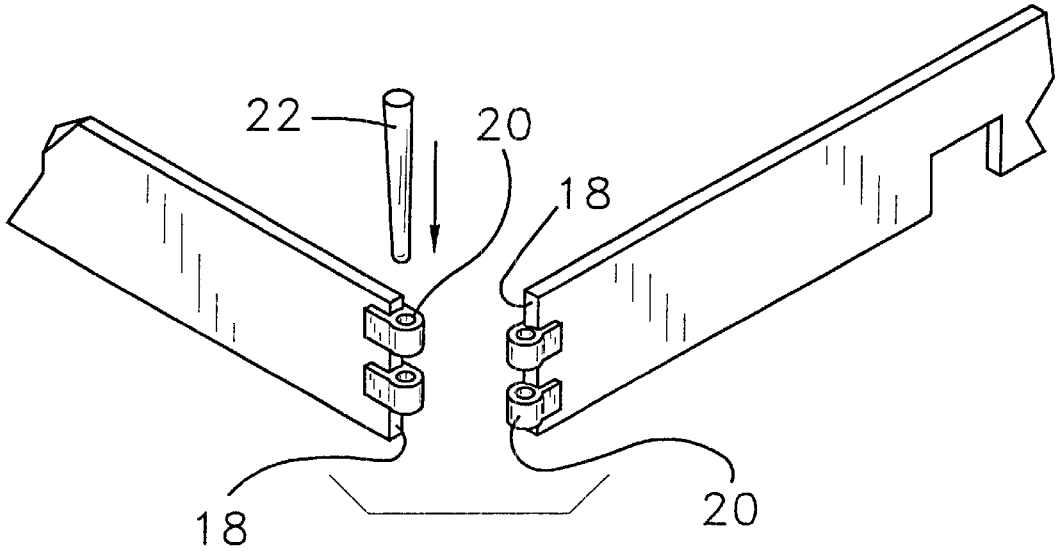
FIG. 4 is a schematic perspective view of the present invention.
Figure 5:
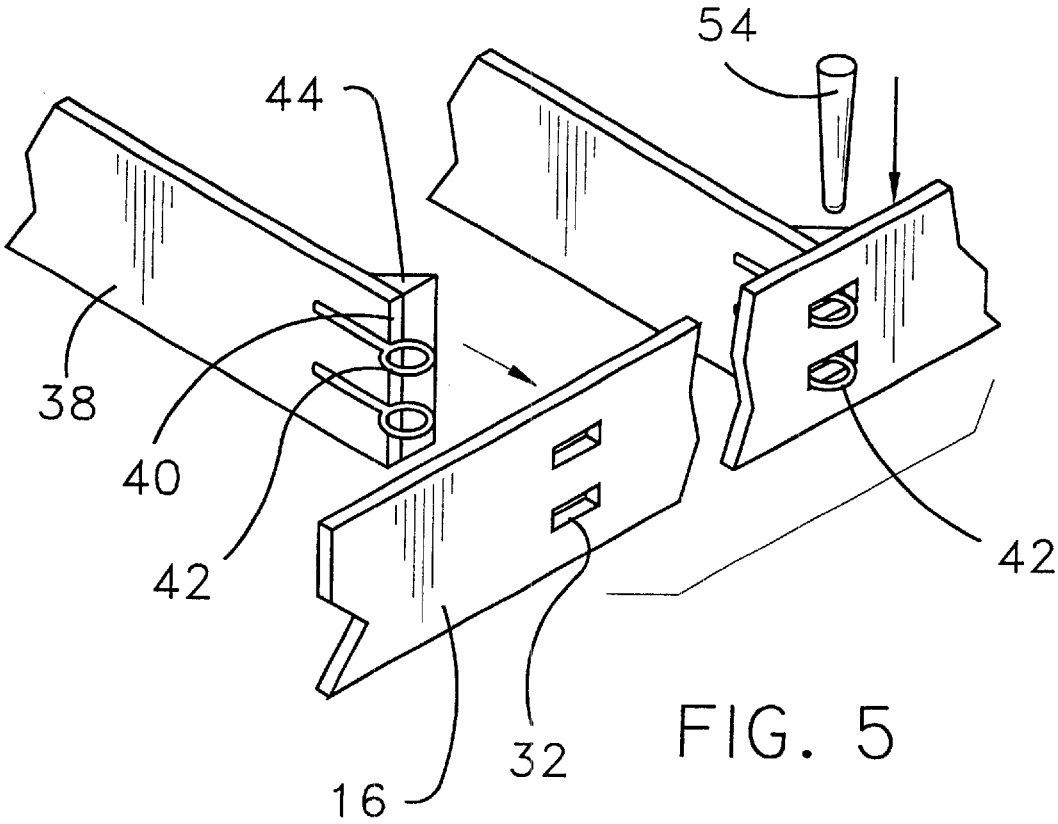
FIG. 5 is a schematic perspective view of the present invention.
Figure 6:
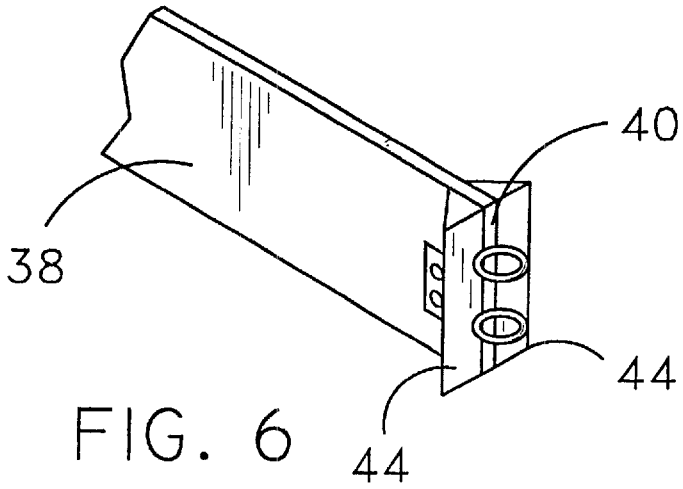
FIG. 6 is a schematic perspective view of the present invention.

With reference now to the drawings, and in particular to FIGS. 1 through 6 thereof, a new hockey game and apparatus embodying the principles and concepts of the present invention and generally designated by the reference numeral 10 will be described.

As best illustrated in FIGS. 1 through 6, the hockey game and apparatus 10 generally comprises a collapsible perimeter frame 12 including a pair of end boards 14 and a pair of side boards 16. Each of the end boards 14 and side boards 16 has a pair of ends 18. A plurality of receiving members 20 for receiving a pin is attached to each of the ends 18 of the end boards 14 and the side boards 16. The receiving members 20 on the side boards 16 are staggered with respect to the receiving members 20 on the end boards 14 when the end boards 14 and the side boards 16 are positioned in a generally rectangular configuration. Each of a plurality of pins 22 is removably extendable into a respective set of staggered receiving members 20 for selectively coupling the end boards 14 to the side boards 16. The end 14 and side 16 boards each have an inside surface 24 and an outside surface 26. Each of the end boards 14 has an aperture 28 therein extending through the inside 24 and outside 26 surfaces and is generally centrally located. The apertures 28 extend through a respective bottom edge 30 of the end boards 14. Each of the side boards 16 has a plurality of slots 32 extending therethrough. The slots 32 are aligned between the ends 18 of the side boards 16. A generally equal amount of distance extends between adjacent slots 32 and between slots 32 and an adjacent end 18 of the side boards 16. Each of the slots 32 in one of the side boards 16 is aligned with one of the slots 32 in the other of the side boards 16. Preferably, the side boards 16 each have four slots 32 therein. Each of the end boards 14 has a length preferably equal to 4 feet. The side boards 16 have a length preferably equal to 8 feet. Each of the side 16 and end 14 boards has a height preferably between 4 inches and 6 inches. Ideally, the slots 32 are pairs of slots positioned vertically with respect to each other. The perimeter frame 12 may be positioned on a panel 36.

A plurality of supports 34 is attached to the outside surfaces 26 of the side 16 and end 14 boards. Each of the supports 34 is positioned generally adjacent to bottom edges 30 of the side 16 and end 14 boards.

Each of a plurality of dividers 38 has a length generally equal to a distance between the side boards 16. Each of the dividers 38 has a pair of ends 40. Each of a plurality of pairs of loop members 42 is attached to one of the ends 40 of the dividers 38. The dividers 38 each have a pair of stabilizers 44 attached thereto such that each of the stabilizers 44 of a pair of stabilizers is located adjacent to one of the ends 40 of a respective divider 38. Alternatively, two pairs of stabilizers 44 may be attached to each divider 38 such that there is a pair of stabilizers 44 on each side of the divider 38. A first two 46 of the dividers 38 has an opening 48 therein positioned generally between opposite ends 40 of the divider 46 and extending through a bottom edge 50 of the dividers 46. A second two 52 of the dividers 38 has a pair of spaced openings 48 therein extending through the bottom edge 50 of the dividers 38.

Each of the dividers 38 is positioned in the perimeter frame 12 such that each pair loop members 42 extends through one of slots 32 and the dividers 38 are orientated generally parallel with the end boards 14. The first two dividers 46 are generally centrally located and each one of the second two dividers 52 is positioned relatively adjacent to one of the end boards 14. Each of a plurality of fastening members 54 is extended into each of the pairs of loop members 42.

A hockey puck 56 and a pair of hockey sticks 58 are also required to play the game.

Rules of the Game

The puck 56 is positioned between the first pair of dividers 46. Each player chooses a goal. The goals are defined by the apertures 28 in the end boards.

The players compete to move the hockey puck 56 through the openings 48 in the dividers 38 toward the other player's goal. If a player twice intentionally holds the puck 56 against a divider 38 or boards 14, 16 such that it cannot move, the puck 56 is moved past the next adjacent divider 38 toward that player's goal 28. Preferably, the players must keep their feet between a line drawn dividing the side boards 16 and their goal 28.

The game is won by the player who moves the hockey puck 56 through the other player's goal 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a hockey game comprising the steps of:

providing a collapsible perimeter frame including a pair of end boards and a pair of side boards, each of said end boards having an aperture therein extending through a bottom edge of said end boards;

providing a plurality of dividers each having a length generally equal to a distance between said side boards, a first two of said dividers having an opening therein positioned generally between opposite ends of the divider and extending through a bottom edge of the dividers, a second two of said dividers having a pair of spaced openings therein extending through said bottom edge of the dividers;

positioning each of said dividers in said perimeter frame;

providing a first player and a second player;

providing a hockey puck;

providing a pair of hockey sticks such that each of said players uses one of said hockey sticks;

positioning said hockey puck within said perimeter frame;

choosing a goal by each of said players, said goals being defined by said apertures;

moving said hockey puck through said openings in said dividers toward the other player's goal;

winning the game being determined by the player who moves said hockey puck through the other player's goal; and each of said side boards having a plurality of slots extending therethrough, said slots being aligned between said ends of said side boards, a generally equal amount of distance extending between adjacent slots and between slots and an adjacent end of said side boards, wherein each of said slots in one of said side boards is aligned with one of said slots in the other of said side boards, each of a plurality of pairs of loop members being attached to one of said ends of said dividers such that each of said pair of loop members extends through one of said slots and said dividers are orientated generally parallel with said end boards, and extending one of a plurality of fastening members into each of said pairs of loop members.

2. The method of playing a hockey game as in claim 1, wherein each of said end boards and side boards has a pair of ends, a plurality of receiving members for receiving a pin being attached to each of said ends of said end boards and said side boards, said receiving members on said side boards being staggered with respect to said receiving members on said end boards when said end boards and said side boards are positioned in a generally rectangular configuration, each of a plurality of pins being removably extendable into a respective set of staggered receiving members for selectively coupling said end boards to said side boards.

3. The method of playing a hockey game as in claim 1, wherein said first two dividers are generally centrally located and each one of said second two dividers are positioned relatively adjacent to one of said end boards.

4. The method of playing a hockey game as in claim 1, wherein each of said end boards is provided with a length generally equal to 4 feet, each of said side boards having a length generally equal to 8 feet, each of said side and end boards has a height generally between 4 inches and 6 inches.

5. The method of playing a hockey game as in claim 1, further including the step of providing a plurality of supports being attached to said outside surfaces of said side and end boards, each of said supports being positioned generally adjacent to bottom edges of said side and end boards.

6. A method of playing a hockey game comprising the steps of:

providing a collapsible perimeter frame including a pair of end boards and a pair of side boards, each of said end boards and side boards having a pair of ends, a plurality of receiving members for receiving a pin being attached to each of said ends of said end boards and said side boards, said receiving members on said side boards being staggered with respect to said receiving members on said end boards when said end boards and said side boards are positioned in a generally rectangular configuration, each of a plurality of pins being removably extendable into a respective set of staggered receiving members for selectively coupling said end boards to said side boards, each of said end and side boards having an inside surface and an outside surface, each of said end boards having an aperture therein extending through said inside and outside surfaces and being generally centrally located, said apertures extending through a respective bottom edge of said end boards, each of said side boards having a plurality of slots extending therethrough, said slots being aligned between said ends of said side boards, a generally equal amount of distance extending between adjacent slots and between slots and an adjacent end of said side boards, wherein each of said slots in one of said side boards is aligned with one of said slots in the other of said side boards, each of said side boards having four slots therein, each of said end boards having a length generally equal to 4 feet, each of said side boards having a length generally equal to 8 feet, each of said side and end boards having a height generally between 4 inches and 6 inches;

providing a plurality of supports being attached to said outside surfaces of said side and end boards, each of said supports being positioned generally adjacent to bottom edges of said side and end boards;

providing a plurality of dividers each having a length generally equal to a distance between said side boards, each of said dividers having a pair of ends, each of a plurality of pairs of loop members being attached to one of said ends of said dividers, each of said dividers having a pair of stabilizers attached thereto such that each of said stabilizers of a pair of stabilizers is located adjacent to one of the ends of a respective divider, a first two of said dividers having an opening therein positioned generally between opposite ends of the divider and extending through a bottom edge of the dividers, a second two of said dividers having a pair of spaced openings therein extending through said bottom edge of the dividers;

positioning each of said dividers in said perimeter frame such that each pair loop members extends through one of slots and said dividers are orientated generally parallel with said end boards, said first two dividers being generally centrally located and each one of said second two dividers being positioned relatively adjacent to one of said end boards;

extending one of a plurality of fastening members into each of said pairs of loop members;

providing a first player and a second player;

providing a hockey puck;

providing a pair of hockey sticks such that each of said players uses one of said hockey sticks;

positioning said puck between said first pair of dividers;

choosing a goal by each of said players, said goals being defined by said apertures;

moving said hockey puck through said openings in said dividers toward the other player's goal; and winning the game being determined by the player who moves said hockey puck through the other player's goal.

7. A hockey game for use with a hockey puck and hockey sticks, said game comprising:

a collapsible perimeter frame including a pair of end boards and a pair of side boards, each of said end boards and side boards having a pair of ends, a plurality of receiving members for receiving a pin being attached to each of said ends of said end boards and said side boards, said receiving members on said side boards being staggered with respect to said receiving members on said end boards when said end boards and said side boards are positioned in a generally rectangular configuration, each of a plurality of pins being removably extendable into a respective set of staggered receiving members for selectively coupling said end boards to said side boards, each of said end and side boards having an inside surface and an outside surface, each of said end boards having an aperture therein extending through said inside and outside surfaces and being generally centrally located, said apertures extending through a respective bottom edge of said end boards, each of said side boards having a plurality of slots extending therethrough, said slots being aligned between said ends of said side boards, a generally equal amount of distance extending between adjacent slots and between slots and an adjacent end of said side boards, wherein each of said slots in one of said side boards is aligned with one of said slots in the other of said side boards, each of said side boards having four slots therein, each of said end boards having a length generally equal to 4 feet, each of said side boards having a length generally equal to 8 feet, each of said side and end boards having a height generally between 4 inches and 6 inches;

a plurality of supports being attached to said outside surfaces of said side and end boards, each of said supports being positioned generally adjacent to bottom edges of said side and end boards; and a plurality of dividers each having a length generally equal to a distance between said side boards, each of said dividers having a pair of ends, each of a plurality of pairs of loop members being attached to one of said ends of said dividers, each of said dividers having a pair of stabilizers attached thereto such that each of said stabilizers of a pair of stabilizers is located adjacent to one of the ends of a respective divider, a first two of said dividers having an opening therein positioned generally between opposite ends of the divider and extending through a bottom edge of the dividers, a second two of said dividers having a pair of spaced openings therein extending through said bottom edge of the dividers, each of said dividers being positioned in said perimeter frame such that each pair loop members extends through one of slots and said dividers are orientated generally parallel with said end boards, said first two dividers being generally centrally located and each one of said second two dividers being positioned relatively adjacent to one of said end boards, each of a plurality of fastening members being extended into each of said pairs of loop members.

* * * * *